US009480126B1

(12) United States Patent
Xiong et al.

(10) Patent No.: US 9,480,126 B1
(45) Date of Patent: Oct. 25, 2016

(54) METHOD TO DETECT UNEVEN AC LOAD OR PARALLEL LOAD REMOVAL

(71) Applicant: Universal Lighting Technologies, Inc., Madison, AL (US)

(72) Inventors: Wei Xiong, Madison, AL (US); Danny Pugh, Harvest, AL (US)

(73) Assignee: Universal Lighting Technologies, Inc., Madison, AL (US)

( * ) Notice: Subject to any disclaimer, the term of this patent is extended or adjusted under 35 U.S.C. 154(b) by 290 days.

(21) Appl. No.: 14/336,440

(22) Filed: Jul. 21, 2014

Related U.S. Application Data

(60) Provisional application No. 61/856,245, filed on Jul. 19, 2013.

(51) Int. Cl.

| | |
|---|---|
| ***H05B 41/16*** | (2006.01) |
| ***H05B 41/24*** | (2006.01) |
| ***H05B 41/36*** | (2006.01) |
| ***H05B 37/02*** | (2006.01) |
| ***H05B 39/04*** | (2006.01) |
| ***G05F 1/00*** | (2006.01) |
| ***H01F 38/10*** | (2006.01) |
| *H05B 41/285* | (2006.01) |
| *H01F 30/04* | (2006.01) |
| *H05B 41/282* | (2006.01) |

(52) U.S. Cl.
CPC ..... *H05B 37/0209* (2013.01); *H01F 38/10* (2013.01); *H01F 30/04* (2013.01); *H05B 41/2822* (2013.01); *H05B 41/2851* (2013.01); *H05B 41/2855* (2013.01); *Y10S 315/05* (2013.01)

(58) Field of Classification Search
CPC ..... H05B 37/02; H05B 33/0851; H05B 41/2822; H05B 41/2855; H05B 41/2851; Y02B 20/348; Y10T 307/406; H01F 38/10; H01F 30/04; Y10S 315/05; Y10S 174/02
USPC ..... 315/297, 153, 274–289, 291, 307, 315/312–326, 185 S, 224, 247
See application file for complete search history.

(56) References Cited

U.S. PATENT DOCUMENTS

| | | | | |
|---|---|---|---|---|
| 8,610,366 | B1 * | 12/2013 | Xiong | H05B 41/2822 315/209 R |
| 2007/0007910 | A1 * | 1/2007 | Kim | H05B 41/2827 315/282 |
| 2007/0182343 | A1 * | 8/2007 | Kwon | H05B 41/245 315/282 |
| 2008/0061710 | A1 * | 3/2008 | Ushijima | H05B 41/2822 315/277 |
| 2014/0175984 | A1 * | 6/2014 | Mieskoski | H05B 41/391 315/127 |

* cited by examiner

*Primary Examiner* — Alexander H Taningco
*Assistant Examiner* — Christian L Garcia
(74) *Attorney, Agent, or Firm* — Patterson Intellectual Property Law, P.C.; Mark J. Patterson

(57) ABSTRACT

A ballast configured for multiple parallel lamp operation includes a system for detecting unbalanced loads or absent lamps in a parallel multiple lamp ballast. The ballast includes one or more starting transformers having windings, each winding connected in series with a lamp connected to the ballast. A winding of one or more of the starting transformers that is not connected in series with one of the lamps is monitored for a voltage in excess of a threshold. A voltage in excess of the threshold across the winding is indicative of an unbalanced load (e.g., an absent or broken lamp). If a voltage above the threshold is detected across the monitored load, the ballast ceases powering the lamps.

20 Claims, 2 Drawing Sheets

METHOD TO DETECT UNEVEN AC LOAD OR PARALLEL LOAD REMOVAL

CROSS-REFERENCES TO RELATED APPLICATIONS

This application claims priority to and hereby incorporates by reference in its entirety U.S. Provisional Patent Application Ser. No. 61/856,245 entitled "A METHOD TO DETECT UNEVEN AC LOAD OR PARALLEL LOAD REMOVAL" filed on Jul. 19, 2013.

A portion of the disclosure of this patent document contains material that is subject to copyright protection. The copyright owner has no objection to the reproduction of the patent document or the patent disclosure, as it appears in the U.S. Patent and Trademark Office patent file or records, but otherwise reserves all copyright rights whatsoever.

STATEMENT REGARDING FEDERALLY SPONSORED RESEARCH OR DEVELOPMENT

Not Applicable

REFERENCE TO SEQUENCE LISTING OR COMPUTER PROGRAM LISTING APPENDIX

Not Applicable

BACKGROUND OF THE INVENTION

The present invention relates generally to parallel multiple lamp ballasts. More particularly, the invention relates to protecting parallel multiple lamp ballasts from unsafe high voltage conditions following removal of a lamp from connection with the ballast and protecting parallel multiple lamp ballasts from unbalanced loads which can affect reliability of the ballast.

Parallel multiple lamp ballasts are widely used due to their low cost and low load impedance, especially when operating at dimmed output levels. Sensing removal of a lamp or of unbalanced lamp currents is difficult and expensive because the lamps are connected in parallel with respect to an oscillator (e.g., inverter) and resonant tank of the ballast. This difficulty is amplified when the ballast is operating at a dimmed output level. If a lamp is removed from electrical connection with the ballast during operation of the ballast, the voltage at the contacts that the lamp was removed from will become excessive and unsafe if the ballast continues operating normally. Further, unbalanced loads can cause breakdown in various components of the ballast if the unbalanced load becomes too great (e.g., when a lamp is removed from connection with the ballast while the ballast is operating). This can reduce the reliability of parallel multiple lamp ballasts.

BRIEF SUMMARY OF THE INVENTION

Aspects of the present invention provide a system for detecting unbalanced loads or absent lamps in a parallel multiple lamp ballast. The ballast includes one or more starting transformers having windings, each winding connected in series with a lamp connected to the ballast. A winding of one or more of the starting transformers that is not connected in series with one of the lamps is monitored for a voltage in excess of a threshold. A voltage in excess of the threshold across the winding is indicative of an unbalanced load (e.g., an absent or broken lamp). If a voltage above the threshold is detected across the monitored load, the ballast ceases powering the lamps.

In one aspect, a ballast configured to connect to a plurality of lamps and provide an alternating current (AC) power to the plurality of lamps includes an oscillator, a starting transformer, and an unbalanced load sensing circuit. The oscillator receives direct current (DC) power from the DC power rail and provides the AC power to the plurality of lamps. The starting transformer includes a primary winding, a first secondary winding, and a second secondary winding. The primary winding of the starting transformer is configured to connect in series with a first lamp of the plurality of lamps. The first secondary winding of the starting transformer is configured to connect in series with a second lamp of the plurality of lamps. The unbalanced load sensing circuit is connected to the second secondary winding of the starting transformer. The unbalanced load sensing circuit monitors a voltage across the second secondary winding of the starting transformer and provides a shut down signal to the oscillator when the voltage across the second secondary winding of the starting transformer exceeds a threshold. The oscillator is further configured to cease providing the AC power to the plurality of lamps in response to receiving the shut down signal from the unbalanced load sensing circuit.

In another aspect, a ballast is configured to connect to plurality of lamps, provide AC power to the plurality of lamps, and cease providing AC power to the plurality of lamps in response to a missing lamp or uneven lamp current. The ballast includes an oscillator, a first starting transformer, a second starting transformer, a third starting transformer, and an unbalanced load sensing circuit. The first starting transformer includes a primary winding and a first secondary winding. The primary winding of the first starting transformer connects in series with a first lamp of the plurality of lamps. The first secondary winding of the first starting transformer connects in series with a second lamp of the plurality of lamps. The second starting transformer has a primary winding and a first secondary winding. The primary winding of the second starting transformer connects in series with the first secondary winding of the first starting transformer and the second lamp of the plurality of lamps. The first secondary winding of the second starting transformer connects in series with a fourth lamp of the plurality of lamps. The third starting transformer has a primary winding and a first secondary winding. The primary winding of the third starting transformer connects in series with a third lamp of the plurality of lamps. The first secondary winding of the third starting transformer connects in series with the primary winding of the first starting transformer and the first lamp. The unbalanced load sensing circuit is connected to a secondary winding of one of the starting transformers. The unbalanced load sensing circuit monitors a voltage across the connected second secondary winding of the starting transformer and provides a shut down signal to the oscillator when the voltage across the connected second secondary winding of the starting transformer exceeds a threshold. The oscillator ceases providing the AC power to the plurality of lamps in response to receiving the shut down signal from the unbalanced load sensing circuit.

In another aspect, a light fixture is configured to receive power from a power source and provide power to a plurality of lamps. The light fixture includes an input stage, a ballast, and a housing. The input stage is configured to connect to the power source and provide a DC power rail. The housing supports the input stage, the ballast, and the plurality of lamps. The ballast is configured to connect to the plurality of lamps and provide alternating current power to the plurality of lamps. The ballast includes an oscillator, a starting transformer, and an unbalanced load sensing circuit. The oscillator receives DC power from the DC power rail and provides the AC power to the plurality of lamps. The starting transformer includes a primary winding, a first secondary winding, and a second secondary winding. The primary winding of the starting transformer connects in series with a first lamp of the plurality of lamps. The first secondary winding of the starting transformer connects in series with a second lamp of the plurality of lamps. The unbalanced load sensing circuit is connected to the second secondary winding of the starting transformer. The unbalanced load sensing circuit monitors a voltage across the second secondary winding of the starting transformer and provides a shut down signal to the oscillator when the voltage across the second secondary winding of the starting transformer exceeds a threshold. The oscillator ceases providing the AC power to the plurality of lamps in response to receiving the shut down signal from the unbalanced load sensing circuit.

BRIEF DESCRIPTION OF THE SEVERAL VIEWS OF THE DRAWINGS

Reference will now be made in detail to optional embodiments of the invention, examples of which are illustrated in accompanying drawings. Whenever possible, the same reference numbers are used in the drawing and in the description referring to the same or like parts.

DETAILED DESCRIPTION OF THE INVENTION

Figure 1:
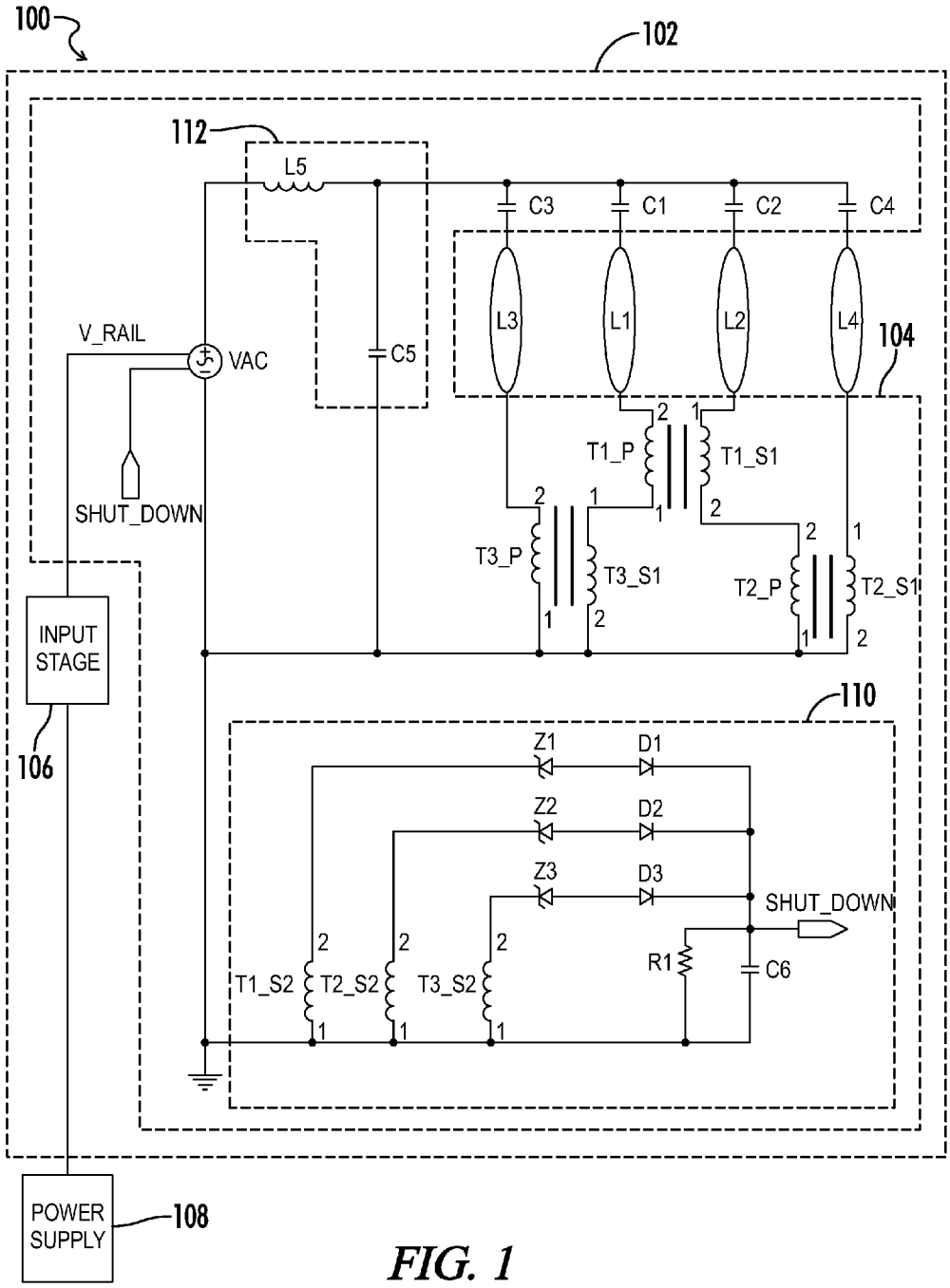
FIG. 1 a block diagram and partial schematic diagram of a light fixture including a parallel multiple lamp ballast having an unbalanced load sensing circuit configured to monitor multiple starting transformers.

While the making and using of various embodiments of the present invention are discussed in detail below, it should be appreciated that the present invention provides many applicable inventive concepts that can be embodied in a wide variety of specific contexts. The specific embodiments discussed herein are merely illustrative of specific ways to make and use the invention and do not delimit the scope of the invention.

To facilitate the understanding of the embodiments described herein, a number of terms are defined below. The terms defined herein have meanings as commonly understood by a person of ordinary skill in the areas relevant to the present invention. Terms such as "a," "an," and "the" are not intended to refer to only a singular entity, but rather include the general class of which a specific example may be used for illustration. The terminology herein is used to describe specific embodiments of the invention, but their usage does not delimit the invention, except as set forth in the claims.

The phrase "in one embodiment," as used herein does not necessarily refer to the same embodiment, although it may. Conditional language used herein, such as, among others, "can," "might," "may," "e.g.," and the like, unless specifically stated otherwise, or otherwise understood within the context as used, is generally intended to convey that certain embodiments include, while other embodiments do not include, certain features, elements and/or states. Thus, such conditional language is not generally intended to imply that features, elements and/or states are in any way required for one or more embodiments or that one or more embodiments necessarily include logic for deciding, with or without author input or prompting, whether these features, elements and/or states are included or are to be performed in any particular embodiment.

The terms "coupled" and "connected" mean at least either a direct electrical connection between the connected items or an indirect connection through one or more passive or active intermediary devices.

The term "circuit" means at least either a single component or a multiplicity of components, either active and/or passive, that are coupled together to provide a desired function.

The terms "power converter" and "converter" unless otherwise defined with respect to a particular element may be used interchangeably herein and with reference to at least DC-DC, DC-AC, AC-DC, buck, buck-boost, boost, half-bridge, full-bridge, H-bridge or various other forms of power conversion or inversion as known to one of skill in the art.

Terms such as "providing," "processing," "supplying," "determining," "calculating" or the like may refer at least to an action of a computer system, computer program, signal processor, logic or alternative analog or digital electronic device that may be transformative of signals represented as physical quantities, whether automatically or manually initiated.

As used herein, "ballast" and "driver circuit" refer to any circuit for providing power (e.g., current) from a power source to a light source. Additionally, "light source" refers to one or more light emitting devices such as fluorescent lamps, high intensity discharge lamps, incandescent bulbs, and solid state light-emitting elements such as light emitting diodes (LEDs), organic light emitting diodes (OLEDs), and plasmaloids. Further, "connected between" or "connected to" means electrically connected when referring to electrical devices in circuit schematics or diagrams.

Referring to FIG. 1, a light fixture 100 receives power from a power supply 108 and provides power to a plurality of lamps (e.g., a first lamp L1, a second lamp L2, a third lamp L3, and a fourth lamp L4). The light fixture 100 includes an input stage 106, a ballast 104, and a housing 102. The housing 102 supports the input stage 106, the ballast 104, and the plurality of lamps. In one embodiment, the housing 102 is configured to support the lamps in electrical contact with the ballast 104. The input stage 106 connects to the power supply 108 and provides a direct current (DC) power rail V_RAIL. In one embodiment, the power supply 108 is an alternating current (AC) power line (e.g., 120 V at 60 Hz), and the input stage 106 is a power factor correcting AC to DC converter. In one embodiment, the lamps of the plurality of lamps are fluorescent lamps, and the lamps are connected in parallel to the ballast 104.

The ballast 104 connects to the plurality of lamps and provides power to the plurality of lamps. The ballast 104 includes an oscillator VAC, a starting transformer T1, and an unbalanced load sensing circuit 110. The oscillator receives DC power from the DC power rail V_RAIL and provides the AC power to the plurality of lamps. The starting transformer T1 includes a primary winding T1_P, a first secondary winding T1_S1, and a second secondary winding T1_S2. The primary winding T1_P of the starting transformer T1 connects in series with the first lamp L1 of the plurality of lamps when the first lamp L1 is connected to the ballast 104 (e.g., when the first lamp L1 is inserted into the housing 102 of the fixture 100). The first secondary winding T1_S1 of the starting transformer T1 connects in series with the second lamp L2 of the plurality of lamps when the second lamp L2 is connected to the ballast 104. In one embodiment, the primary winding T1_P and the first secondary winding T1_S1 of the starting transformer T1 have approximately the same number of turns. In another embodiment, all of the windings of the first transformer T1 (i.e., the primary winding T_P, the first secondary winding T1_S1, and the second secondary winding T1_S2) have approximately the same number of turns.

The unbalanced load sensing circuit 110 is connected to the second secondary winding T1_S2 of the starting transformer T1. The unbalanced load sensing circuit 110 monitors a voltage across the second secondary winding T1_S2 of the starting transformer T1 and provides a shut down signal SHUT_DOWN to the oscillator VAC when the voltage across the second secondary winding T1_S2 of the starting transformer T1 exceeds a threshold. The oscillator VAC is configured to cease providing the AC power to the plurality of lamps in response to receiving the shut down signal SHUT_DOWN from the unbalanced load sensing circuit 110.

In one embodiment, the unbalanced load sensing circuit 110 includes a first Zener diode Z1, a first diode D1, and an output capacitor C6. The second secondary winding T1_S2 of the starting transformer T1 has a first terminal and a second terminal. The oscillator VAC has a first terminal and a second terminal. The second terminal of the second secondary winding T1_S2 of the starting transformer T1 is connected to the second terminal of the oscillator VAC. The first Zener diode Z1 has a threshold voltage, an anode, and a cathode. The cathode of the first Zener diode Z1 is connected to the first terminal of the second secondary winding T1_S2 of the starting transformer T1. The first diode D1 has an anode and a cathode. The anode of the first diode D1 is connected to the anode of the first Zener diode Z1. The output capacitor C6 is connected between the cathode of the first diode D1 and the second terminal of the second secondary winding T1_S2 of the starting transformer T1. The cathode of the first diode D1 provides the shut down signal SHUT_DOWN to the oscillator VAC when the voltage across the second secondary winding T1_S2 of the starting transformer T1 exceeds the threshold voltage of the first Zener diode Z1.

In the embodiment shown in FIG. 1, the ballast 104 includes a second starting transformer T2 and a third starting transformer T3. The second starting transformer T2 has a primary winding T2_P, a first secondary winding T2_S1, and a second secondary winding T2_S2. The primary winding T2_P of the second starting transformer T2 connects in series with the first secondary winding T1_S1 of the first starting transformer T1 and the second lamp L2 when the second lamp L2 is connected to the ballast 104. The first secondary winding T2_S1 of the second starting transformer T2 connects in series with a fourth lamp L4 of the plurality of lamps when the fourth lamp L4 is connected to the ballast 104.

The third starting transformer T3 has a primary winding T3_P, a first secondary winding T3_S1, and a second secondary winding T3_S2. The primary winding T3_P of the third starting transformer T3 connects in series with a third lamp L3 of the plurality of lamps when the third lamp L3 is connected to the ballast 104. The first secondary winding T3_S1 of the third starting transformer T3 connects in series with the primary winding T1_P of the first starting transformer T1 and the first lamp L1 when the first lamp L1 is connected to the ballast 104. In one embodiment, the primary winding T1_P of the first starting transformer T1, the first secondary winding T1_S1 of the first starting transformer T1, the primary winding T2_P of the second starting transformer T2, the first secondary winding T2_S1 of the second starting transformer T2, the primary winding T3_P of the third starting transformer T3, and the first secondary winding T3_S1 of the third starting transformer T3 each have approximately the same number of turns. In one embodiment, the second secondary windings of the starting transformers have the same number of turns as the primary windings and first secondary windings of the starting transformers. In operation, the first, second, and third starting transformers cooperate to balance current between the lamps. Because the current is the approximately the same through the transformer windings in a balanced load condition, the second secondary windings of the first, second, and/or third starting transformers generally have little to no voltage across them.

In the embodiment of the unbalanced load sensing circuit 110 shown in FIG. 1, the unbalanced load sensing circuit 110 monitors a voltage of the second secondary winding of each of the first transformer T1, the second transformer T2, and the third transformer T3. The unbalanced load sensing circuit 110 is connected to the second secondary winding T1_S1 of the first starting transformer T1, the second secondary winding T2_S2 of the second starting transformer T2, and the second secondary winding T3_S2 of the third starting transformer T3. The unbalanced load sensing circuit 110 provides the shut down signal SHUT_DOWN to the oscillator VAC when the voltage across any of the second secondary windings exceeds the threshold (e.g., a threshold of a Zener diode associated with each of the second secondary windings).

In one embodiment, the second secondary winding T2_S2 of the second starting transformer T2 has a first terminal and a second terminal, and the second secondary winding T3_S2 of the third starting transformer T3 has a first terminal and a second terminal. The second terminal of the second secondary winding T2_S2 of the second starting transformer T2 is connected to the second terminal of the oscillator VAC, and the second terminal of the second secondary winding T3_S2 of the third starting transformer T3 is connected to the second terminal of the oscillator VAC. In one embodiment, the unbalanced load sensing circuit 110 further includes a second Zener diode Z2, a third Zener diode Z3, a second diode D2, and a third diode D3. The second Zener diode Z2 has a threshold voltage, and anode, and a cathode. The cathode of the second Zener diode Z2 is connected to the first terminal of the second secondary winding T2_S2 of the second starting transformer T2. The third Zener diode D3 has a threshold voltage, and anode, and a cathode. The cathode of the third Zener diode Z3 is connected to the first terminal of the second secondary winding T3_S2 of the third starting transformer T3. The second diode D2 has an anode and a cathode, and the anode of the second diode D2 is connected to the anode of the second Zener diode D2. The third diode D3 has an anode and a cathode, and the anode of the third diode D3 is connected to the anode of the third Zener diode D3. The first terminal of the bleed down resistor R1 is connected to the cathode of the first diode D1, the cathode of the second diode D2, and the cathode of the third diode.

In one embodiment, the threshold voltage of the first Zener diode Z1, the threshold voltage of the second Zener diode Z2, and the threshold voltage of the third Zener diode D3 are all approximately the same threshold voltage, and the cathode of the first diode D1 (i.e., the first terminal of the output capacitor C6) provides the shut down signal SHUT-_DOWN to the oscillator VAC when the voltage across the second secondary winding of any of the first second or third starting transformers exceeds the common threshold voltage of the Zener diodes. The Zener diodes thus set the sensing threshold of the unbalanced load sensing circuit 110. The diodes (e.g., D1, D2, and D3) prevent negative current at output capacitor C6 while the bleeding resistor R1 discharges the output capacitor C6 during normal operating conditions.

When a lamp is removed or damaged, a large voltage appears at the monitored second secondary winding(s), the threshold of the corresponding Zener diode is exceeded, and a large charge develops at the output capacitor C6, providing the shut down signal SHUT_DOWN to the oscillator VAC. The threshold voltage of the Zener diode(s) is selected in conjunction with the turns ratio between the monitored second secondary winding and the primary winding and/or first secondary winding such that small transient voltage spikes during normal operation of the ballast 104 do not exceed the threshold of the Zener diode(s) and lead to inadvertent shut down of the ballast 104.

In one embodiment, the ballast 104 further includes a resonant tank circuit 112 connected between the oscillator VAC and the plurality of lamps. The resonant tank circuit 112 includes a resonant inductor L5 and a resonant capacitor C5. The resonant inductor L5 has a first terminal connected to the first terminal of the oscillator VAC. The resonant capacitor C5 has a first terminal connected to the second terminal of the resonant inductor L5 and a second terminal connected to the second terminal of the oscillator VAC.

In one embodiment, the ballast 104 further includes a plurality of lamp capacitors connected between the resonant tank 112 and the plurality of lamps. A first lamp capacitor C1 of the plurality of lamp capacitors is connected in series with the first lamp L1 and the primary winding T1_P of the starting transformer T1 between the first terminal and the second terminal of the resonant capacitor. For example, the first lamp capacitor C1 connects the second terminal of the resonant inductor L5 to the first lamp L1 when the first lamp L1 is connected to the ballast 108. A second lamp capacitor C2 of the plurality of lamp capacitors connects in series with the second lamp L2 and the first secondary winding T1_S1 of the starting transformer T1. For example, the second lamp capacitor C2 connects the second terminal of the resonant inductor L5 to the second lamp L2 when the second lamp L2 is connected to the ballast 108. In one embodiment, a third lamp capacitor C3 connects in series with the third lamp L3 of the plurality of lamps when the third lamp L3 is connected to the ballast 104, and a fourth lamp capacitor C4 connects in series with the fourth lamp L4 of the plurality of lamps when the fourth lamp L4 is connected to the ballast 104.

Figure 2:
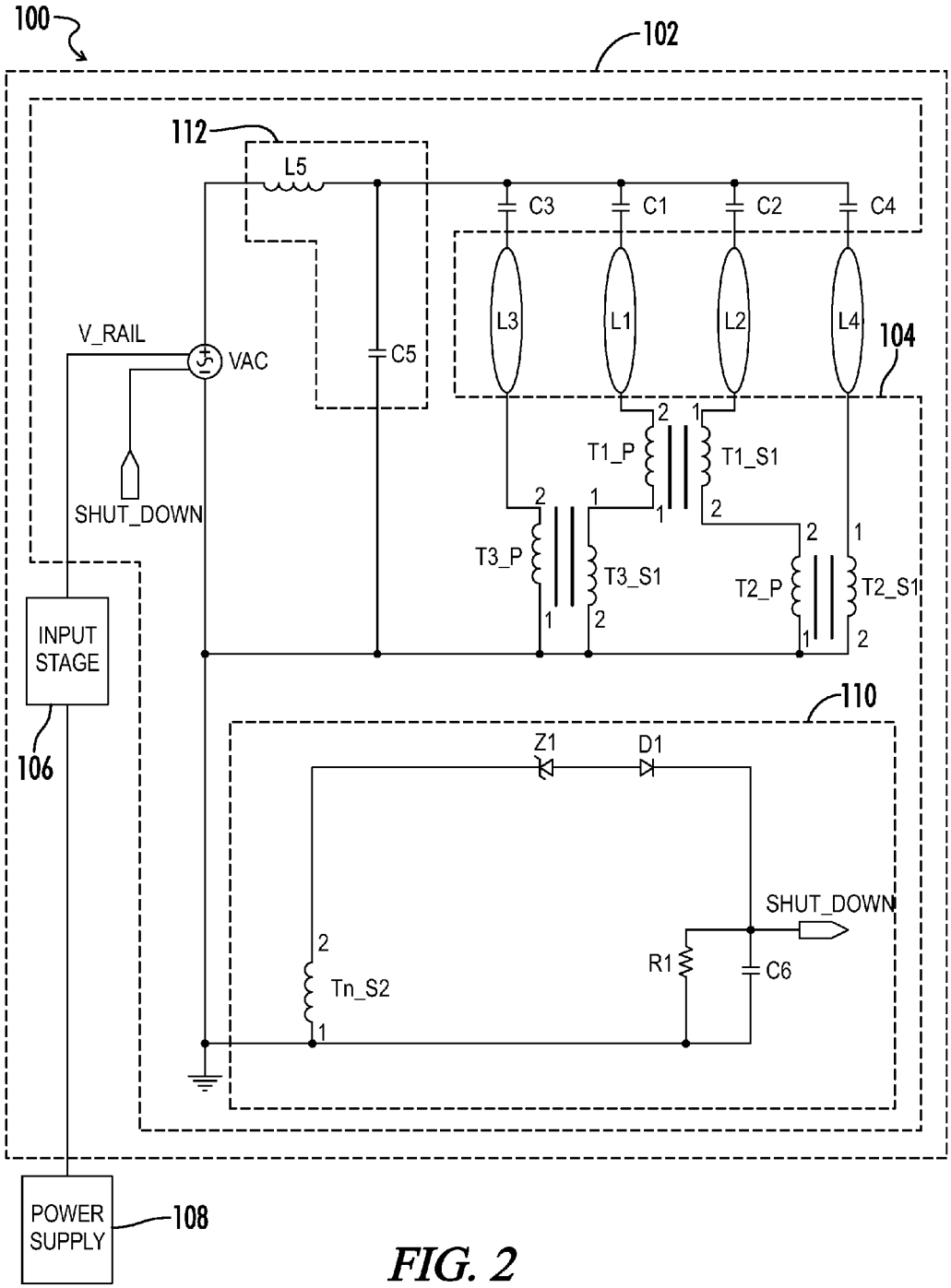
FIG. 2 a block diagram and partial schematic diagram of a light fixture including a parallel multiple lamp ballast having an unbalanced load sensing circuit configured to monitor a single starting transformer.

Referring to FIG. 2, the unbalanced load sensing circuit 110 is shown monitoring exactly one second secondary winding Tn_S2 of exactly one of the starting transformers Tn (where n is representative of any of the first, second or third transformers). This is possible because any load imbalance causes an excess voltage to appear at the second secondary windings of all of the starting transformers.

In one embodiment, all of the windings of all of the transformers have the same number of turns. It is contemplated within the scope of the claims that the transformer windings may be connected in configurations other than as described herein to achieve current balance among the parallel lamps. It is further contemplated within the scope of the claims that any of the second secondary windings may be monitored for excess voltage by the unbalanced load sensing circuit 110 to determine an absent or damaged lamp. Although referred to herein as a primary winding, first secondary winding, and second secondary winding, it is contemplated that these terms are interchangeable (e.g., when the windings all have the same number of turns), and that the unbalanced load sensing circuit 110 is monitoring the winding of the starting transformer not connected in series with the lamps (e.g., the second secondary winding).

It will be understood by those of skill in the art that information and signals may be represented using any of a variety of different technologies and techniques (e.g., data, instructions, commands, information, signals, bits, symbols, and chips may be represented by voltages, currents, electromagnetic waves, magnetic fields or particles, optical fields or particles, or any combination thereof). Likewise, the various illustrative logical blocks, modules, circuits, and algorithm steps described herein may be implemented as electronic hardware, computer software, or combinations of both, depending on the application and functionality. Moreover, the various logical blocks, modules, and circuits described herein may be implemented or performed with a general purpose processor (e.g., microprocessor, conventional processor, controller, microcontroller, state machine or combination of computing devices), a digital signal processor ("DSP"), an application specific integrated circuit ("ASIC"), a field programmable gate array ("FPGA") or other programmable logic device, discrete gate or transistor logic, discrete hardware components, or any combination thereof designed to perform the functions described herein. Similarly, steps of a method or process described herein may be embodied directly in hardware, in a software module executed by a processor, or in a combination of the two. Although embodiments of the present invention have been described in detail, it will be understood by those skilled in the art that various modifications can be made therein without departing from the spirit and scope of the invention as set forth in the appended claims.

This written description uses examples to disclose the invention and also to enable any person skilled in the art to practice the invention, including making and using any devices or systems and performing any incorporated methods. The patentable scope of the invention is defined by the claims, and may include other examples that occur to those skilled in the art. Such other examples are intended to be within the scope of the claims if they have structural elements that do not differ from the literal language of the claims, or if they include equivalent structural elements with insubstantial differences from the literal languages of the claims.

It will be understood that the particular embodiments described herein are shown by way of illustration and not as limitations of the invention. The principal features of this invention may be employed in various embodiments without departing from the scope of the invention. Those of ordinary skill in the art will recognize numerous equivalents to the specific procedures described herein. Such equivalents are considered to be within the scope of this invention and are covered by the claims.

All of the compositions and/or methods disclosed and claimed herein may be made and/or executed without undue experimentation in light of the present disclosure. While the compositions and methods of this invention have been described in terms of the embodiments included herein, it will be apparent to those of ordinary skill in the art that variations may be applied to the compositions and/or methods and in the steps or in the sequence of steps of the method described herein without departing from the concept, spirit, and scope of the invention. All such similar substitutes and modifications apparent to those skilled in the art are deemed to be within the spirit, scope, and concept of the invention as defined by the appended claims.

Thus, although there have been described particular embodiments of the present invention of a new and useful METHOD TO DETECT UNEVEN AC LOAD OR PARALLEL LOAD REMOVAL it is not intended that such references be construed as limitations upon the scope of this invention except as set forth in the following claims.

What is claimed is:

1. A ballast configured to connect to a plurality of lamps and provide alternating current (AC) power to the plurality of lamps, the ballast comprising:

an oscillator configured to receive direct current (DC) power from a DC power rail and provide the AC power to the plurality of lamps;

a starting transformer comprising a primary winding configured to connect in series with a first lamp of the plurality of lamps, a first secondary winding configured to connect in series with a second lamp of the plurality of lamps, and a second secondary winding; and an unbalanced load sensing circuit connected to the second secondary winding of the starting transformer, wherein the unbalanced load sensing circuit is configured to monitor a voltage across the second secondary winding of the starting transformer and provide a shut down signal to the oscillator when the voltage across the second secondary winding of the starting transformer exceeds a threshold;

wherein the oscillator is further configured to cease providing the AC power to the plurality of lamps in response to receiving the shut down signal from the unbalanced load sensing circuit.

2. The ballast of claim 1, wherein:

the oscillator has a first terminal and a second terminal; and the ballast further comprises a resonant tank configured to connect the oscillator to the plurality of lamps, the resonant tank comprising a resonant inductor having a first terminal and a second terminal, wherein the first terminal of the resonant inductor is connected to the first terminal of the oscillator, and a resonant capacitor having a first terminal and a second terminal, wherein the first terminal of the resonant capacitor is connected to the second terminal of the resonant inductor and the second terminal of the resonant capacitor is connected to the second terminal of the oscillator.

3. The ballast of claim 1, wherein:

the oscillator has a first terminal and a second terminal;

the ballast further comprises a resonant tank configured to connect the oscillator to the plurality of lamps, the resonant tank comprising a resonant inductor having a first terminal and a second terminal, wherein the first terminal of the resonant inductor is connected to the first terminal of the oscillator, and a resonant capacitor having a first terminal and a second terminal, wherein the first terminal of the resonant capacitor is connected to the second terminal of the resonant inductor and the second terminal of the resonant capacitor is connected to the second terminal of the oscillator; and the ballast further comprises a plurality of lamp capacitors comprising a first capacitor configured to connect in series with the first lamp and the primary winding of the starting transformer between the first terminal and the second terminal of the resonant capacitor, and a second capacitor configured to connect in series with the second lamp and the first secondary winding of the starting transformer.

4. The ballast of claim 1, wherein:

the oscillator has a first terminal and a second terminal;

the second secondary winding of the starting transformer has a first terminal and a second terminal;

the second terminal of the second secondary winding of the starting transformer is connected to the second terminal of the oscillator;

the unbalanced load sensing circuit comprises a first Zener diode having a threshold voltage, an anode, and a cathode, wherein the cathode of the first Zener diode is connected to the first terminal of the second secondary winding of the starting transformer, a first diode having an anode and a cathode, wherein the anode of the first diode is connected to the anode of the first Zener diode, a bleed down resistor connected between the cathode of the first diode and the second terminal of the second secondary winding of the starting transformer, and an output capacitor connected between the cathode of the first diode and the second terminal of the second secondary winding of the starting transformer; and the cathode of the first diode is configured to provide the shut down signal to the oscillator when the voltage across the second secondary winding exceeds the threshold voltage of the first Zener diode.

5. The ballast of claim 1, wherein the primary winding and the first secondary winding of the starting transformer have approximately the same number of turns.

6. The ballast of claim 1, wherein the primary winding, the first secondary winding, and second secondary winding of the starting transformer have approximately the same number of turns.

7. The ballast of claim 1, wherein the starting transformer is a first starting transformer, and the ballast further comprises:

a second starting transformer having a primary winding, a first secondary winding, and a second secondary winding, wherein the primary winding of the second starting transformer is configured to connect in series with the first secondary winding of the first starting transformer and the second lamp, and the first secondary winding of the second starting transformer is configured to connect in series with a fourth lamp of the plurality of lamps; and a third starting transformer having a primary winding, a first secondary winding, and a second secondary winding, wherein the primary winding of the third starting transformer is configured to connect in series with a third lamp of the plurality of lamps, and the first secondary winding of the third starting transformer is configured to connect in series with the primary winding of the first starting transformer and the first lamp;

wherein the unbalanced load sensing circuit is connected to the second secondary winding of the first starting transformer, the second secondary winding of the second starting transformer, and the second secondary winding of the third starting transformer and the unbalanced load sensing circuit is configured to monitor a voltage across the second secondary windings of each of the first, second, and third starting transformers and provide a shut down signal to the oscillator when the voltage across any of the second secondary windings exceeds the threshold; and wherein the primary winding of the first starting transformer, the first secondary winding of the first starting transformer, the primary winding of the second starting transformer, the first secondary winding of the second starting transformer, the primary winding of the third starting transformer, and the first secondary winding of the third starting transformer each have approximately the same number of turns.

8. The ballast of claim 1, wherein:

the starting transformer is a first starting transformer;

the ballast further comprises a second starting transformer having a primary winding, a first secondary winding, and a second secondary winding, wherein:

the primary winding of the second starting transformer is configured to connect in series with the first secondary winding of the first starting transformer and the second lamp, and the first secondary winding of the second starting transformer is configured to connect in series with a fourth lamp of the plurality of lamps; and a third starting transformer having a primary winding, a first secondary winding, and a second secondary winding, wherein the primary winding of the third starting transformer is configured to connect in series with a third lamp of the plurality of lamps, and the first secondary winding of the third starting transformer is configured to connect in series with the primary winding of the first starting transformer and the first lamp; and the oscillator has a first terminal and a second terminal;

the second secondary winding of the first starting transformer has a first terminal and a second terminal;

the second secondary winding of the second starting transformer has a first terminal and a second terminal;

the second secondary winding of the third starting transformer has a first terminal and a second terminal;

the second terminal of the second secondary winding of the first starting transformer is connected to the second terminal of the oscillator;

the second terminal of the second secondary winding of the second starting transformer is connected to the second terminal of the oscillator;

the second terminal of the second secondary winding of the third starting transformer is connected to the second terminal of the oscillator;

the unbalanced load sensing circuit comprises a first Zener diode having a threshold voltage, an anode, and a cathode, wherein the cathode of the first Zener diode is connected to the first terminal of the second secondary winding of the first starting transformer, a second Zener diode having a threshold voltage, an anode, and a cathode, wherein the cathode of the second Zener diode is connected to the first terminal of the second secondary winding of the second starting transformer, a third Zener diode having a threshold voltage, an anode, and a cathode, wherein the cathode of the third Zener diode is connected to the first terminal of the second secondary winding of the third starting transformer, a first diode having an anode and a cathode, wherein the anode of the first diode is connected to the anode of the first Zener diode, a second diode having an anode and a cathode, wherein the anode of the second diode is connected to the anode of the second Zener diode, a third diode having an anode and a cathode, wherein the anode of the third diode is connected to the anode of the third Zener diode, a bleed down resistor having a first terminal and a second terminal, wherein the first terminal of the bleed down resistor is connected to the cathode of the first diode, the cathode of the second diode, and the cathode of the third diode, and the second terminal of the bleed down resistor is connected to the second terminal of the second secondary winding of the first starting transformer, and an output capacitor connected between the cathode of the first diode and the second terminal of the second secondary winding of the starting transformer;

the second secondary winding of the first starting transformer, the second secondary winding of the second starting transformer, and the second secondary winding of the third starting transformer all have approximately the same number of turns;

the threshold voltage of the first Zener diode, the threshold voltage of the second Zener diode, and the threshold voltage of the third Zener diode are all approximately the same threshold voltage; and the cathode of the first diode is configured to provide the shut down signal to the oscillator when the voltage across the second secondary winding of any of the first, second, or third starting transformers exceeds the threshold voltage of the first, second, or third Zener diode.

9. The ballast of claim 1, wherein:

the oscillator has a first terminal and a second terminal;

the ballast further comprises a resonant tank configured to connect the oscillator to the plurality of lamps, the resonant tank comprising a resonant inductor having a first terminal and a second terminal, wherein the first terminal of the resonant inductor is connected to the first terminal of the oscillator, and a resonant capacitor having a first terminal and a second terminal, wherein the first terminal of the resonant capacitor is connected to the second terminal of the resonant inductor and the second terminal of the resonant capacitor is connected to the second terminal of the oscillator, and the ballast further comprises a plurality of lamp capacitors comprising a first capacitor configured to connect in series with the first lamp and the primary winding of the starting transformer between the first terminal and the second terminal of the resonant capacitor, a second capacitor configured to connect in series with the second lamp and the first secondary winding of the starting transformer, a third capacitor configured to connect in series with a third lamp of the plurality of lamps, and a fourth capacitor configured to connect in series with a fourth lamp of the plurality of lamps.

10. A ballast configured to connect to a plurality of lamps, provide alternating current (AC) power to the plurality of lamps, and cease providing AC power to the plurality of lamps in response to a missing lamp or uneven lamp current, the ballast comprising:

an oscillator configured to provide the AC power to the plurality of lamps;

a first starting transformer comprising a primary winding configured to connect in series with a first lamp of the plurality of lamps, a first secondary winding configured to connect in series with a second lamp of the plurality of lamps, and a second starting transformer having a primary winding and a first secondary winding, wherein the primary winding of the second starting transformer is configured to connect in series with the first secondary winding of the first starting transformer and the second lamp, and the first secondary winding of the second starting transformer is configured to connect in series with a fourth lamp of the plurality of lamps; and a third starting transformer having a primary winding and a first secondary winding, wherein the primary winding of the third starting transformer is configured to connect in series with a third lamp of the plurality of lamps, and the first secondary winding of the third starting transformer is configured to connect in series with the primary winding of the first starting transformer and the first lamp; and an unbalanced load sensing circuit connected to a second secondary winding of one of the starting transformers, wherein the unbalanced load sensing circuit is configured to monitor a voltage across the connected second secondary winding of the starting transformer and provide a shut down signal to the oscillator when the voltage across the connected second secondary winding of the starting transformer exceeds a threshold;

wherein the oscillator is further configured to cease providing the AC power to the plurality of lamps in response to receiving the shut down signal from the unbalanced load sensing circuit.

11. A light fixture configured to receive power from an alternating current (AC) power supply and provide power to a plurality of lamps, the light fixture comprising:

an input stage configured to connect to the power supply and provide a direct current (DC) power rail;

a ballast configured to connect to a plurality of lamps and provide AC power to the plurality of lamps, the ballast comprising an oscillator configured to receive DC power from the DC power rail and provide the AC power to the plurality of lamps, a starting transformer comprising a primary winding configured to connect in series with a first lamp of the plurality of lamps, a first secondary winding configured to connect in series with a second lamp of the plurality of lamps, and a second secondary winding;

an unbalanced load sensing circuit connected to the second secondary winding of the starting transformer, wherein the unbalanced load sensing circuit is configured to monitor a voltage across the second secondary winding of the starting transformer and provide a shut down signal to the oscillator when the voltage across the second secondary winding of the starting transformer exceeds a threshold;

wherein the oscillator is further configured to cease providing the AC power to the plurality of lamps in response to receiving the shut down signal from the unbalanced load sensing circuit; and a housing configured to support the input stage, the ballast, and the plurality of lamps.

12. The light fixture of claim 11, wherein:

the oscillator has a first terminal and a second terminal; and the ballast further comprises a resonant tank configured to connect the oscillator to the plurality of lamps, the resonant tank comprising a resonant inductor having a first terminal and a second terminal, wherein the first terminal of the resonant inductor is connected to the first terminal of the oscillator, and a resonant capacitor having a first terminal and a second terminal, wherein the first terminal of the resonant capacitor is connected to the second terminal of the resonant inductor and the second terminal of the resonant capacitor is connected to the second terminal of the oscillator.

13. The light fixture of claim 11, wherein:

the oscillator has a first terminal and a second terminal;

the ballast further comprises a resonant tank configured to connect the oscillator to the plurality of lamps, the resonant tank comprising a resonant inductor having a first terminal and a second terminal, wherein the first terminal of the resonant inductor is connected to the first terminal of the oscillator, and a resonant capacitor having a first terminal and a second terminal, wherein the first terminal of the resonant capacitor is connected to the second terminal of the resonant inductor and the second terminal of the resonant capacitor is connected to the second terminal of the oscillator; and the ballast further comprises a plurality of lamp capacitors comprising a first capacitor configured to connect in series with the first lamp and the primary winding of the starting transformer between the first terminal and the second terminal of the resonant capacitor, and a second capacitor configured to connect in series with the second lamp and the first secondary winding of the starting transformer.

14. The light fixture of claim 11, wherein:

the oscillator has a first terminal and a second terminal;

the second secondary winding of the starting transformer has a first terminal and a second terminal;

the second terminal of the second secondary winding of the starting transformer is connected to the second terminal of the oscillator;

the unbalanced load sensing circuit comprises a first Zener diode having a threshold voltage, an anode, and a cathode, wherein the cathode of the first Zener diode is connected to the first terminal of the second secondary winding of the starting transformer, a first diode having an anode and a cathode, wherein the anode of the first diode is connected to the anode of the first Zener diode, a bleed down resistor connected between the cathode of the first diode and the second terminal of the second secondary winding of the starting transformer, and an output capacitor connected between the cathode of the first diode and the second terminal of the second secondary winding of the starting transformer, and the cathode of the first diode is configured to provide the shut down signal to the oscillator when the voltage across the second secondary winding exceeds the threshold voltage of the first Zener diode.

15. The light fixture of claim 11, wherein the primary winding and the first secondary winding of the starting transformer have approximately the same number of turns.

16. The light fixture of claim 11, wherein the primary winding, the first secondary winding, and second secondary winding of the starting transformer have approximately the same number of turns.

17. The light fixture of claim 11, wherein the starting transformer is a first starting transformer, and the ballast further comprises:

a second starting transformer having a primary winding a first secondary winding, and a second secondary winding, wherein the primary winding of the second starting transformer is configured to connect in series with the first secondary winding of the first starting transformer and the second lamp, and the first secondary winding of the second starting transformer is configured to connect in series with a fourth lamp of the plurality of lamps; and a third starting transformer having a primary winding, a first secondary winding, and a second secondary winding, wherein:

the primary winding of the third starting transformer is configured to connect in series with a third lamp of the plurality of lamps, and the first secondary winding of the third starting transformer is configured to connect in series with the primary winding of the first starting transformer and the first lamp;

wherein the unbalanced load sensing circuit is connected to the second secondary winding of the first starting transformer, the second secondary winding of the second starting transformer, and the second secondary winding of the third starting transformer and the unbalanced load sensing circuit is configured to monitor a voltage across the second secondary windings of each of the first, second, and third starting transformers and provide a shut down signal to the oscillator when the voltage across any of the second secondary windings exceeds the threshold; and wherein the primary winding of the first starting transformer, the first secondary winding of the first starting transformer, the primary winding of the second starting transformer, the first secondary winding of the second starting transformer, the primary winding of the third starting transformer, and the first secondary winding of the third starting transformer each have approximately the same number of turns.

18. The light fixture of claim 11, wherein:

the starting transformer is a first starting transformer;

the ballast further comprises a second starting transformer having a primary winding a first secondary winding, and a second secondary winding, wherein the primary winding of the second starting transformer is configured to connect in series with the first secondary winding of the first starting transformer and the second lamp, and the first secondary winding of the second starting transformer is configured to connect in series with a fourth lamp of the plurality of lamps, and a third starting transformer having a primary winding, a first secondary winding, and a second secondary winding, wherein the primary winding of the third starting transformer is configured to connect in series with a third lamp of the plurality of lamps, and the first secondary winding of the third starting transformer is configured to connect in series with the primary winding of the first starting transformer and the first lamp; and the oscillator has a first terminal and a second terminal;

the second secondary winding of the first starting transformer has a first terminal and a second terminal;

the second secondary winding of the second starting transformer has a first terminal and a second terminal;

the second secondary winding of the third starting transformer has a first terminal and a second terminal;

the second terminal of the second secondary winding of the first starting transformer is connected to the second terminal of the oscillator;

the second terminal of the second secondary winding of the second starting transformer is connected to the second terminal of the oscillator;

the second terminal of the second secondary winding of the third starting transformer is connected to the second terminal of the oscillator;

the unbalanced load sensing circuit comprises a first Zener diode having a threshold voltage, an anode, and a cathode, wherein the cathode of the first Zener diode is connected to the first terminal of the second secondary winding of the first starting transformer, a second Zener diode having a threshold voltage, an anode, and a cathode, wherein the cathode of the second Zener diode is connected to the first terminal of the second secondary winding of the second starting transformer, a third Zener diode having a threshold voltage, an anode, and a cathode, wherein the cathode of the third Zener diode is connected to the first terminal of the second secondary winding of the third starting transformer, a first diode having an anode and a cathode, wherein the anode of the first diode is connected to the anode of the first Zener diode, a second diode having an anode and a cathode, wherein the anode of the second diode is connected to the anode of the second Zener diode, a third diode having an anode and a cathode, wherein the anode of the third diode is connected to the anode of the third Zener diode, a bleed down resistor having a first terminal and a second terminal, wherein the first terminal of the bleed down resistor is connected to the cathode of the first diode, the cathode of the second diode, and the cathode of the third diode, and the second terminal of the bleed down resistor is connected to the second terminal of the second secondary winding of the first starting transformer, and an output capacitor connected between the cathode of the first diode and the second terminal of the second secondary winding of the starting transformer;

the second secondary winding of the first starting transformer, the second secondary winding of the second starting transformer, and the second secondary winding of the third starting transformer all have approximately the same number of turns;

the threshold voltage of the first Zener diode, the threshold voltage of the second Zener diode, and the threshold voltage of the third Zener diode are all approximately the same threshold voltage; and the cathode of the first diode is configured to provide the shut down signal to the oscillator when the voltage across the second secondary winding of any of the first, second, or third starting transformers exceeds the threshold voltage of the first, second, or third Zener diode.

19. The light fixture of claim 11, wherein:

the oscillator has a first terminal and a second terminal;

the ballast further comprises a resonant tank configured to connect the oscillator to the plurality of lamps, the resonant tank comprising a resonant inductor having a first terminal and a second terminal, wherein the first terminal of the resonant inductor is connected to the first terminal of the oscillator, and a resonant capacitor having a first terminal and a second terminal, wherein the first terminal of the resonant capacitor is connected to the second terminal of the resonant inductor and the second terminal of the resonant capacitor is connected to the second terminal of the oscillator, and the ballast further comprises a plurality of lamp capacitors comprising a first capacitor configured to connect in series with the first lamp and the primary winding of the starting transformer between the first terminal and the second terminal of the resonant capacitor, a second capacitor configured to connect in series with the second lamp and the first secondary winding of the starting transformer, a third capacitor configured to connect in series with a third lamp of the plurality of lamps, and a fourth capacitor configured to connect in series with a fourth lamp of the plurality of lamps.

20. The light fixture of claim 11, wherein the lamps of the plurality of lamps are fluorescent lamps and the housing is further configured to support the lamps in electrical contact with the ballast.

* * * * *